US007549635B2

(12) United States Patent
Nakashima

(10) Patent No.: US 7,549,635 B2
(45) Date of Patent: Jun. 23, 2009

(54) PAPER CONVEYANCE APPARATUS AND IMAGE RECORDING APPARATUS

(75) Inventor: Atsuhisa Nakashima, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 370 days.

(21) Appl. No.: 11/266,254

(22) Filed: Nov. 4, 2005

(65) Prior Publication Data

US 2006/0098074 A1 May 11, 2006

(30) Foreign Application Priority Data

Nov. 5, 2004 (JP) ..... 2004-322535

(51) Int. Cl.
*B65H 5/06* (2006.01)

(52) U.S. Cl. ..... 271/275; 347/104

(58) Field of Classification Search ..... 271/275, 271/272, 274; 347/104
See application file for complete search history.

(56) References Cited

U.S. PATENT DOCUMENTS 7,036,922 B2 * 5/2006 Nakashima ..... 347/104
2004/0263560 A1 * 12/2004 Nakashima ..... 347/32

FOREIGN PATENT DOCUMENTS

| | | |
|---|---|---|
| JP | 5139563 | 6/1993 |
| JP | 5232129 | 9/1993 |
| JP | 5297737 | 11/1993 |
| JP | 05 319609 | 12/1993 |
| JP | 5319610 | 12/1993 |

OTHER PUBLICATIONS

CN Office Action Dec. 7, 2007, CN App. No. 200510120207.3.

* cited by examiner

*Primary Examiner*—Kaitlin S Joerger
(74) *Attorney, Agent, or Firm*—Banner & Witcoff, Ltd.

(57) ABSTRACT

A paper conveyance apparatus includes an endless type conveyance belt, a driving unit, first and second rollers, a first biasing mechanism and an encoder. The endless type conveyance belt has first and second surfaces. The driving unit drives the conveyance belt. The first roller is in contact with the first surface. The second roller is in contact with the second surface. The first and second rollers nip the conveyance belt therebetween. The first biasing mechanism biases at least one of the first and second rollers so that the first and second rollers come close to each other. The encoder detects a rotation position of the first roller. At least one of the first and second rollers is in contact with at least one of the first and second surfaces in a region outside a paper passing region where a conveyed sheet of paper passes.

21 Claims, 13 Drawing Sheets

PAPER CONVEYANCE APPARATUS AND IMAGE RECORDING APPARATUS

This application is based upon and claims the benefit of priority from Japanese Patent Application No. 2004-322535 filed on Nov. 5, 2005; the entire contents of which are incorporated herein by reference.

BACKGROUND OF THE INVENTION

1. Field of the Invention

The present invention relates to a paper conveyance apparatus for conveying a sheet of paper and an image recording apparatus.

2. Description of the Related Art

An image recording apparatus such as an inkjet printer has a paper conveyance apparatus that includes a pair of driving rollers and an endless type conveyance belt wound on the driving rollers. While the paper conveyance apparatus conveys a sheet of paper, the inkjet printer can form desired images on a sheet of paper by ejecting ink on the sheet of paper from the inkjet head. In this case, the resolution of the formed images in the paper conveyance direction depends on the conveyance accuracy of the paper conveyance apparatus. Consequently, it is necessary to accurately drive the paper conveyance apparatus at a predetermined speed to form images with high resolution. JP Hei.5-297737 A discloses the following paper conveyance apparatus (e.g., see FIG. 1 of JP Hei.5-297737 A). In the paper conveyance apparatus, a speed-detecting roller (encoder roller) attached to a rotary encoder and an opposed roller (encoder nip roller) biased toward the speed-detecting roller nip the endless type conveyance belt wound on the driving rollers. The paper conveyance apparatus controls driving of the conveyance belt on the basis of a rotation position of the speed-detecting roller, which is detected by the rotary encoder. According to the technology, since the rotary encoder can directly detect the rotation speed of the conveyance belt, it is possible to accurately drive the paper conveyance apparatus at a predetermined speed.

SUMMARY OF THE INVENTION

In JP Hei.5-297737 A, the sheet of paper conveyed passes through between the speed-detecting roller and the conveyance belt. For this reason, at the moment when the sheet of paper enters between the speed-detecting roller and the conveyance belt, and at the moment when the sheet of paper is discharged from between the speed-detecting roller and the conveyance belt, the conveyance belt bends in a thickness direction, so that the opposed roller is instantaneously displaced. If the opposed roller is instantaneously displaced, the biasing force of the opposed roller against the conveyance belt varies instantaneously, and the contact pressure between the speed-detecting roller and the conveyance belt varies instantaneously. In this case, the speed-detecting roller does not follow movement of the conveyance belt, and the rotation speed of the conveyance belt is not accurately detected.

The invention provides a paper conveyance apparatus capable of accurately detecting a rotation speed of a conveyance belt and an image recording apparatus using the same.

According to one embodiment of the invention, a paper conveyance apparatus includes an endless type conveyance belt, a driving unit, first and second rollers, a first biasing mechanism and an encoder. The endless type conveyance belt has first and second surfaces. A sheet of paper is to be placed on one of the first and second surfaces. The driving unit drives the conveyance belt. The first roller is in contact with the first surface of the conveyance belt. The second roller is in contact with the second surface of the conveyance belt. The first and second rollers nip the conveyance belt therebetween. The first biasing mechanism biases at least one of the first roller and the second roller so that the first roller and the second roller come close to each other. The encoder detects a rotation position of the first roller. At least one of the first roller and the second roller is in contact with at least one of the first and second surfaces of the conveyance belt in a region outside a paper passing region where a conveyed sheet of paper passes.

According to this structure, the sheet of paper does not pass through between one of the encoder roller and the encoder nip roller, which comes into contact with the front face of the conveyance belt, and the conveyance belt. Therefore, even when the sheet of paper passes above or below an axis of the encoder roller, the encoder roller or the encoder nip roller is not instantaneously displaced. The encoder roller and the encoder nip roller nip the conveyance belt 11 at a constant pressure at any time. Accordingly, it is possible to cause the encoder roller to stably follow the conveyance belt, and to accurately detect the moving speed of the conveyance belt. In addition, the term "paper passing region through which the conveyed sheet of paper passes" refers to a region through which the sheet of paper placed on the conveyance belt passes when the conveyance belt is driven.

According to one embodiment of the invention, an image recording apparatus includes the conveyance apparatus as set forth above and an image forming unit that forms an image on a sheet of paper being conveyed by the conveyance apparatus on a basis of the rotation position of the first roller detected by the encoder.

Furthermore, the image forming unit may include an inkjet head and a head controller. The inkjet head ejects ink onto the sheet of paper conveyed by the conveyance apparatus. The head controller controls a timing at which the inkjet head ejects the ink. The head controller may control the timing on a basis of the rotation position of the first roller detected by the encoder.

According to this structure, it is possible to accurately and quickly correct unusual variation occurring in the conveyance belt by varying the ink ejection timing.

DETAILED DESCRIPTION OF EMBODIMENTS OF THE INVENTION

Hereinafter, a first embodiment according to the invention will be described with reference to the drawings.

Figure 1:
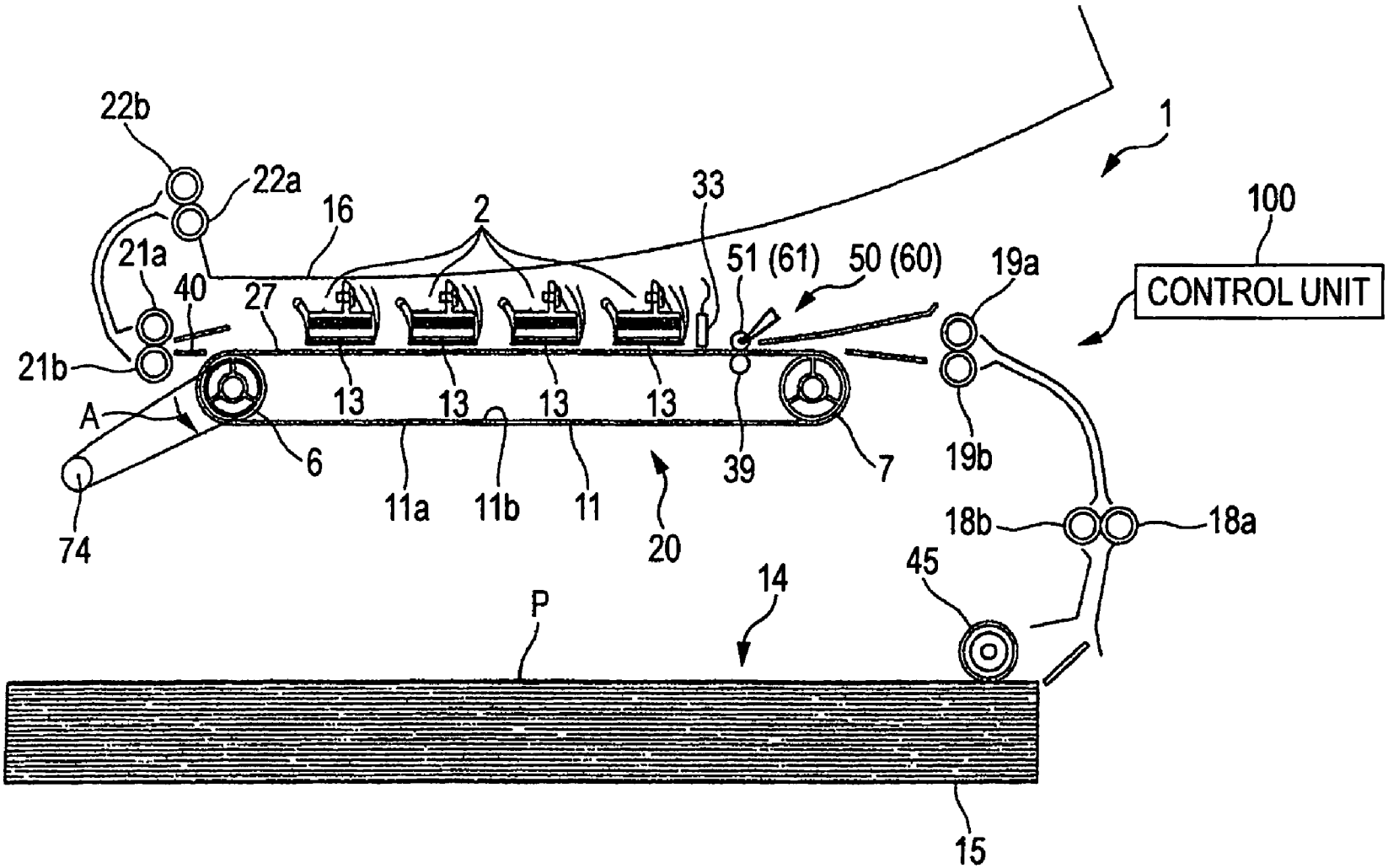
FIG. 1 is a schematic view showing a printer according to a first embodiment of the invention.

First, an inkjet printer of the first embodiment will be described with reference to FIG. 1. The printer 1 shown in FIG. 1 is a line type color inkjet printer having four inkjet heads 2. Each of the inkjet heads 2 has a rectangular shape elongating in a direction perpendicular to the paper of FIG. 1. The printer 1 has a paper-feeding device 14 shown on the lower side of FIG. 1, a paper-receiving unit 16 shown on the upper side of FIG. 1, and a paper conveyance apparatus 20 shown in the middle of FIG. 1. In addition, the printer 1 further includes a control unit 100 for controlling operation of each portion of the printer 1. The four inkjet heads 2 and the control unit 100 serve as an image forming unit.

The paper-feeding device 14 includes a paper-accommodating unit 15 and a paper-feeding roller 45. The paper-accommodating unit 15 can accommodate plural sheets of print paper P therein. The paper-feeding roller 45 feeds the uppermost sheet of print paper P in the paper-accommodating unit 15 to the paper conveyance apparatus 20 one by one. Each of the sheets of print paper P is accommodated in the paper-accommodating unit 15 so as to be fed in the direction parallel to the long side thereof. Feed rollers 18*a*, 18*b*, 19*a*, and 19*b* are disposed between the paper-accommodating unit 15 and the paper conveyance apparatus 20 along a conveyance path of the sheet of paper. A sheet of print paper P discharged from the paper-feeding device 14 is nipped between the feed rollers 18*a* and 18*b*, and is then fed to the upper side of the FIG. 1 so that one short side of the sheet of print paper P serves as a leading edge. After that, the sheet of print paper P is nipped between the feed rollers 19*a* and 19*b*, and is then fed toward the paper conveyance apparatus 20 to the left side of FIG. 1.

The paper conveyance apparatus 20 includes an endless type conveyance belt 11, and two belt rollers 6 and 7 on which the conveyance belt 11 is wound. A length of the conveyance belt 11 is adjusted so that predetermined tension is applied to the conveyance belt 11 wound on the two belt rollers 6 and 7. Since the conveyance belt 11 is wound on the two belt rollers 6 and 7, two flat surfaces are formed on the conveyance belt 11. The two flat surfaces are parallel to each other, and include common tangents of the belt rollers 6 and 7, respectively. A flat surface facing the inkjet heads 2 of the two flat surfaces serves as a surface on which the sheet of print paper P is placed. The sheet of print paper P fed from the paper-feeding device 14 is printed thereon by the inkjet heads 2 during a period in which the sheet of print paper P is being placed and conveyed on the conveyance belt 11, and reaches the paper-receiving unit 16. A plurality of printed sheets of print paper P is placed in the paper-receiving unit 16 to be overlapped. The paper conveyance apparatus 20 will be described in detail below.

Each of the four inkjet heads 2 has a head body 13 on the lower end thereof. The head body 13 is a rectangular parallelepiped shape elongating in the direction perpendicular to the paper of FIG. 1 as viewed in the plan view. The four head bodies 13 are disposed close to one another along the conveyance direction (right/left direction in FIG. 1) in which the paper conveyance apparatus 20 conveys the sheet of print paper P. A number of nozzles with minute diameters are defined in the bottom face (ink discharge face) of each of the four head bodies 13. Colors of inks ejected from the four head bodies 13 are different from one another, and each of the four head bodies 13 ejects any one of magenta (M), yellow (Y), cyan (C), and black (K) inks. That is, colors of inks ejected from a number of nozzles defined in one head body 13 are the same.

A small gap is formed between the bottom face of each head body 13 and the conveyance belt 11. The sheet of print paper P is conveyed from right to left in FIG. 1 through the gap. While the sheet of print paper P sequentially passes below the four head bodies 13, inks are ejected from the nozzles onto the upper surface of the sheet of print paper P, such that desired color images are formed on the sheet of print paper P.

As shown on the left in FIG. 1, a separating plate 40 is disposed on the downstream of the paper conveyance apparatus 20 in the paper conveyance direction. A tip of the separating plate 40 enters between the sheet of print paper P and the conveyance belt 11, and thus, the sheet of print paper P adhered to the surface of the conveyance belt 11 is separated from a paper passing region 27.

Feed rollers 21*a*, 21*b*, 22*a*, and 22*b* are disposed between the paper conveyance apparatus 20 and the paper-receiving unit 16. The sheet of print paper P discharged from the paper conveyance apparatus 20 is nipped between the feed rollers 21*a* and 21*b*, and is then fed to the upper side of FIG. 1 so that one short side of the sheet of print paper P serves as a leading edge. After that, the sheet of print paper P is nipped between the feed rollers 22*a* and 22*b*, and is then fed to the paper-receiving unit 16.

As shown in FIG. 1, a paper sensor 33 including a light-emitting element and a light-receiving element is provided on the upstream of the conveyance belt 11 in the paper conveyance direction. The paper sensor 33 emits light from the light-emitting element to a detecting position on the conveyance belt 11, and then receives a light reflected from the conveyance belt 11 by the light-receiving element. The level of a signal output from the paper sensor 33 reflects an intensity difference in the reflected light between the cases where the sheet of print paper P is present/absent at the detecting position. That is, at timing when the level of the output signal increases drastically, it is considered that the leading edge of the sheet of print paper P reaches the detecting position. Since the output signal from the paper sensor 33 shows if the leading edge of the sheet of print paper P reaches the detecting position, a printing start signal is supplied to each of the inkjet heads 2 in response thereto.

Figure 2:
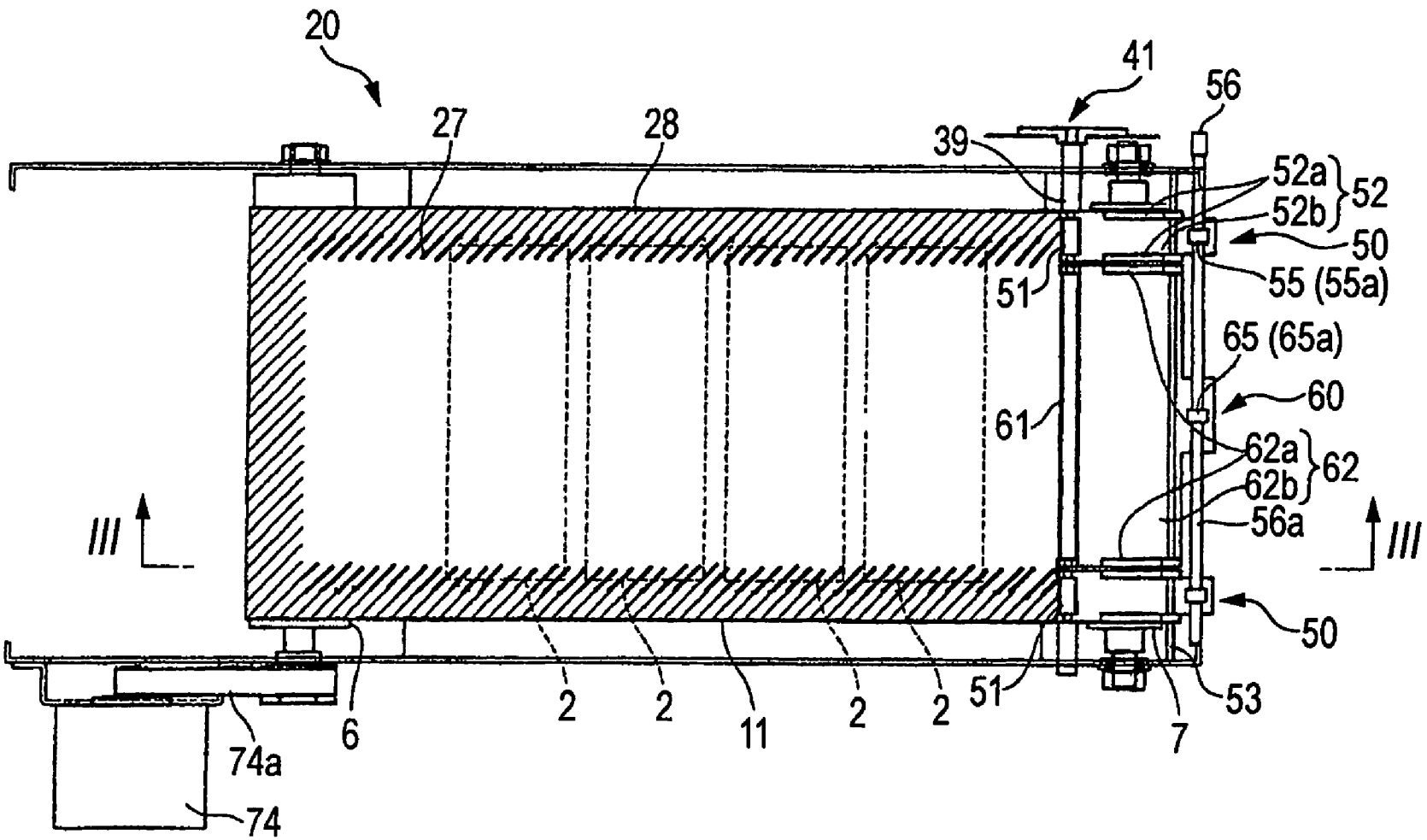
FIG. 2 is a plan view showing a paper conveyance-apparatus shown in FIG. 1.
Figure 3:
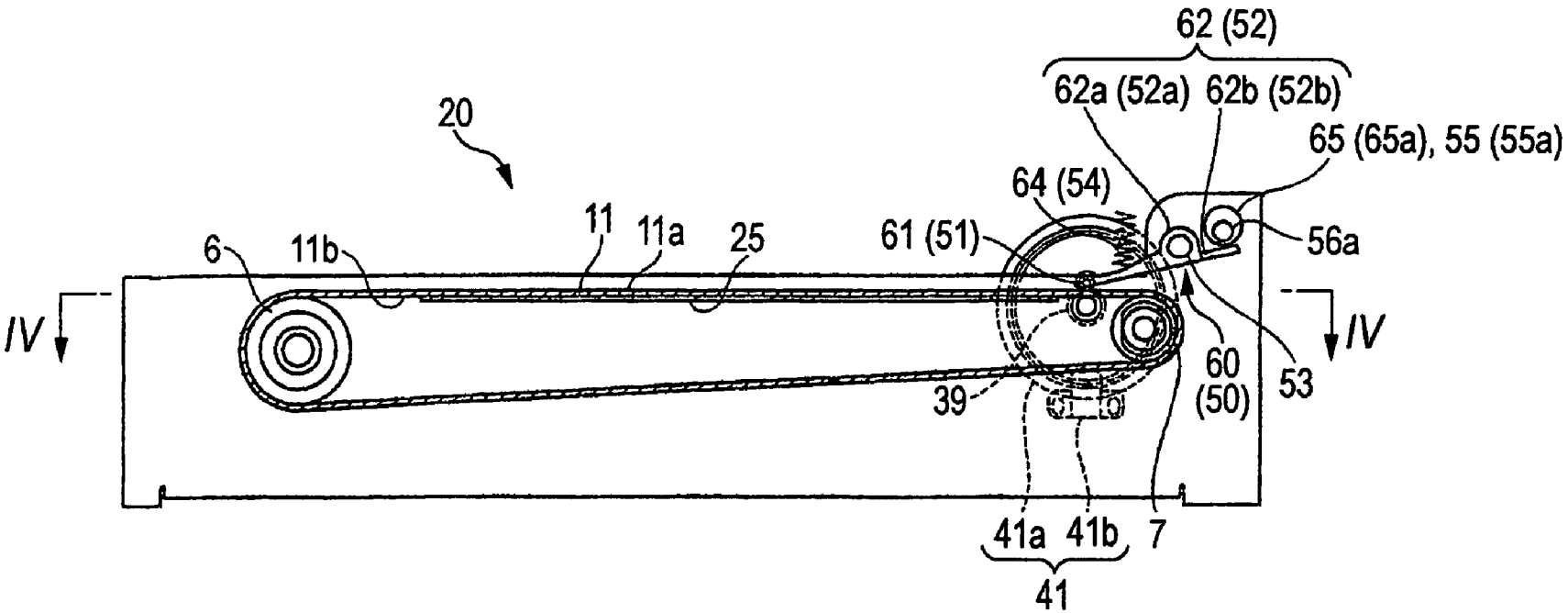
FIG. 3 is a section view taken along line III-III shown in FIG. 2.
Figure 4:
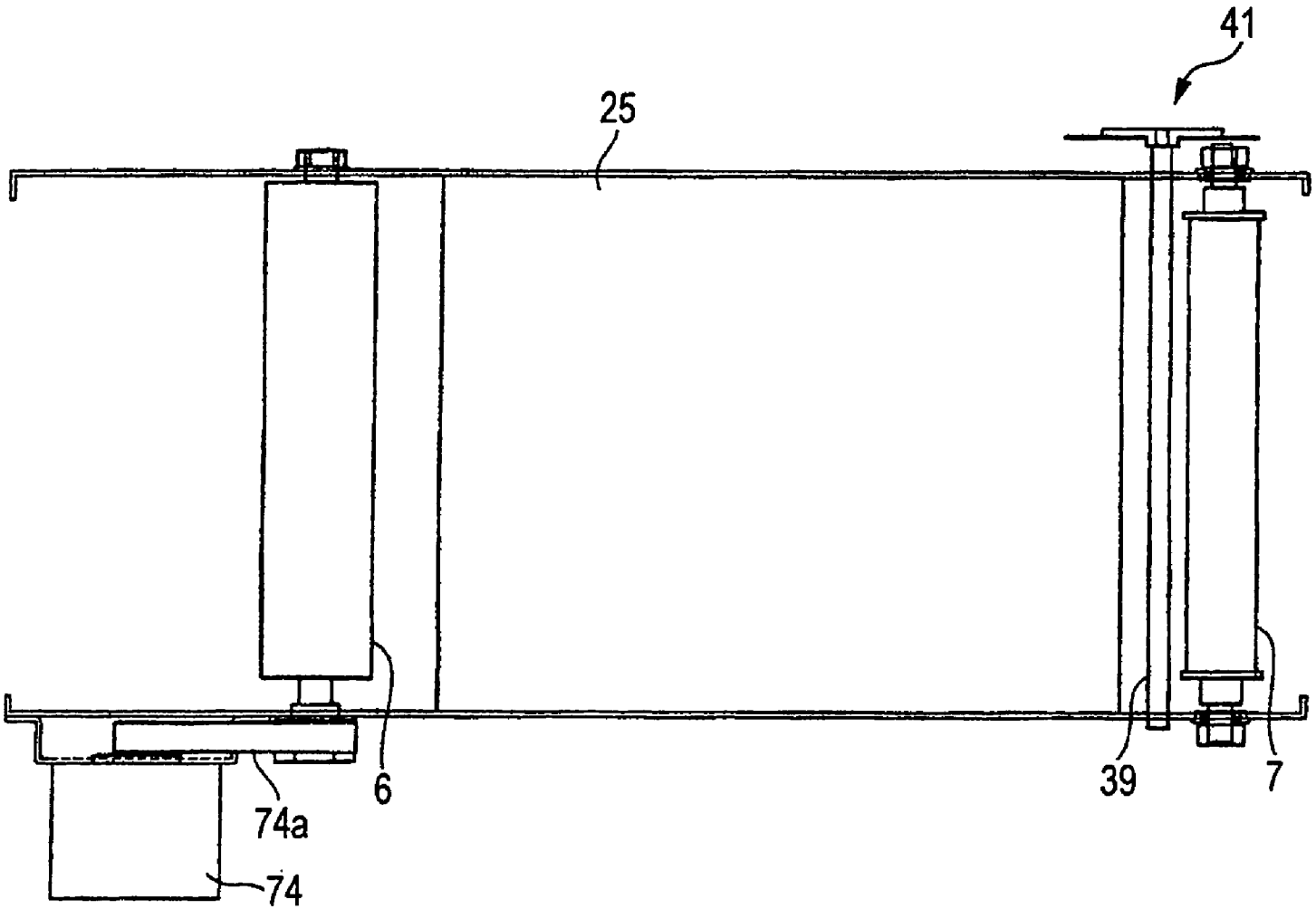
FIG. 4 is a section view taken along line IV-IV shown in FIG. 3.

Next, the paper conveyance apparatus 20 will be described with reference to FIGS. 2 to 4. FIG. 2 is a plan view showing the paper conveyance apparatus 20 when viewed from the side of the inkjet heads 2. FIG. 3 is a section view taken along line III-III shown in FIG. 2. FIG. 4 is a section view taken along line IV-IV shown in FIG. 3.

As shown in FIGS. 1 to 4, the paper conveyance apparatus 20 includes the above-mentioned conveyance belt 11 and the belt rollers 6 and 7, a conveyance motor 74, an encoder roller 39 (serving as a first roller and a third roller), a rotary encoder 41, encoder nip rollers 51 (serving as a second roller), an encoder nip biasing mechanism 50 (serving as a first biasing mechanism) a paper nip roller (serving as a fourth roller) and a paper nip biasing mechanism 60 (serving as a second biasing mechanism). The conveyance motor 74 drives the belt roller 6 via a transmission belt 74*a*. The rotary encoder 41 detects a rotation position of the encoder roller 39. The encoder nip biasing mechanisms 50 rotatably supports the encoder nip rollers 51 and biases the encoder nip rollers 51 in a direction coming close to the encoder roller 39. The paper nip biasing mechanism 60 rotatably supports the paper nip roller 61 and biases the paper nip roller 61 in a direction coming close to the encoder roller 39. The conveyance belt 11 has a base layer 35 and an adhesive layer 36. A material of the base layer 35 is harder than that of the adhesive layer 36. The adhesive layer 36 is made of silicon rubber, which is coated on the whole outer circumferential surface of a base layer 35 (see FIG. 10). The surface of the adhesive layer 36 serves as an outer circumferential surface 11*a* of the conveyance belt 11 on which the sheet of print paper P is placed. The surface of the base layer 35 on which the adhesive layer 36 is not coated serves as an inner circumferential surface 11*b* of the conveyance belt 11. In addition, a region through which the sheet of print paper P passes when the conveyance belt 11 is driven and the sheet of print paper P placed on the conveyance belt is conveyed is referred to as the paper passing region 27. As shown in FIG. 2, the paper passing region 27 is formed in a rectangular shape, which is line-symmetric with respect to a center line of the conveyance belt 11 in the width direction that is perpendicular to a direction in which the conveyance belt 11 moves. Furthermore, the outside of the paper passing region 27 is referred to as a paper non-passing region 28 through which the sheet of print paper P does not pass.

The two belt rollers 6 and 7 extend across the conveyance belt 11 along the width direction of the conveyance belt 11, and come into contact with the inner circumferential surface 11*b* of the conveyance belt 11. The control unit 100 controls the conveyance motor 74 to drive and rotate the conveyance motor 74. When the belt roller 6 is rotated by the conveyance motor 74 in the counterclockwise direction in the drawing (in the direction indicated by an arrow A in FIG. 1), the sheet of print paper P conveyed by the feed rollers 18*a*, 18*b*, 19*a*, and 19*b* is placed on the outer circumferential surface 11*a* of the conveyance belt 11 and is conveyed. The belt roller 7 is a driven roller, which is rotated by the torque transmitted from the conveyance belt 11, following the rotation of the belt roller 6.

As shown in FIGS. 3 and 4, the encoder roller 39 extends across the conveyance belt 11 along the width direction of the conveyance belt 11, and come into contact with the inner circumferential surface 11*b* of the conveyance belt 11. The rotary encoder 41 is provided on one end of the encoder roller 39. The rotary encoder 41 is mounted on the one end of the encoder roller 39, and includes a disk-shaped slip plate 41*a* having a plurality of slits in the outer edge thereof and the optical sensor 41*b* for detecting the slits of the slip plate 41*a*. When the encoder roller 39 rotates, the slit plate 41*a* mounted thereon is rotated as well. When the slit plate 41*a* rotates by a predetermined angle, the optical sensor 41*b* detects that light passes through a slit formed in the slit plate 41*a*. Then, the optical sensor 41*b* outputs a detection signal to the control unit 100. As described below, the control unit 100 detects a moving speed of the conveyance belt 11 on the basis of the detection signal output from the optical sensor 41*b*, and controls the conveyance motor 74 and the inkjet heads 2.

As shown in FIGS. 2 and 3, each of the two encoder nip biasing mechanisms 50 supports the encoder nip roller 51 so that the encoder nip roller 51 faces the encoder roller 39 through the conveyance belt 11 while being positioned in the paper non-passing region 28. In addition, each of the encoder nip biasing mechanisms 50 includes a roller-supporting member 52 for supporting each of the encoder nip rollers 51, and are leasing mechanism 55 for releasing contact between each of the encoder nip rollers 51 and the conveyance belt 11. The roller-supporting member 52 includes a pair of holding arms 52*a* and a connecting member 52*b*. The holding arms 52*a* can swing about a pivot shaft 53 both ends of which are fixed to a frame along a width direction of the conveyance belt 11. The holding arms 52*a* also support both ends of the encoder nip roller 51 rotatably at both ends thereof. The connecting member 52*b* is provided between the pair of holding arms 52*a* to connect them to each other. A biasing spring 54 is mounted between the connecting member 52*b* and the frame (not shown) so as to bias each of the encoder nip rollers 51 in a direction coming close to the encoder roller 39. When the roller-supporting member 52 swings in a direction in which each of the encoder nip rollers 51 comes close to the encoder roller 39, each of the encoder nip rollers 51 comes into contact with the conveyance belt 11 in the paper non-passing region 28 so that each of the encoder nip rollers 51 and the encoder roller 39 nip the conveyance belt 11 therebetween (see FIG. 5).

Figure 5A:
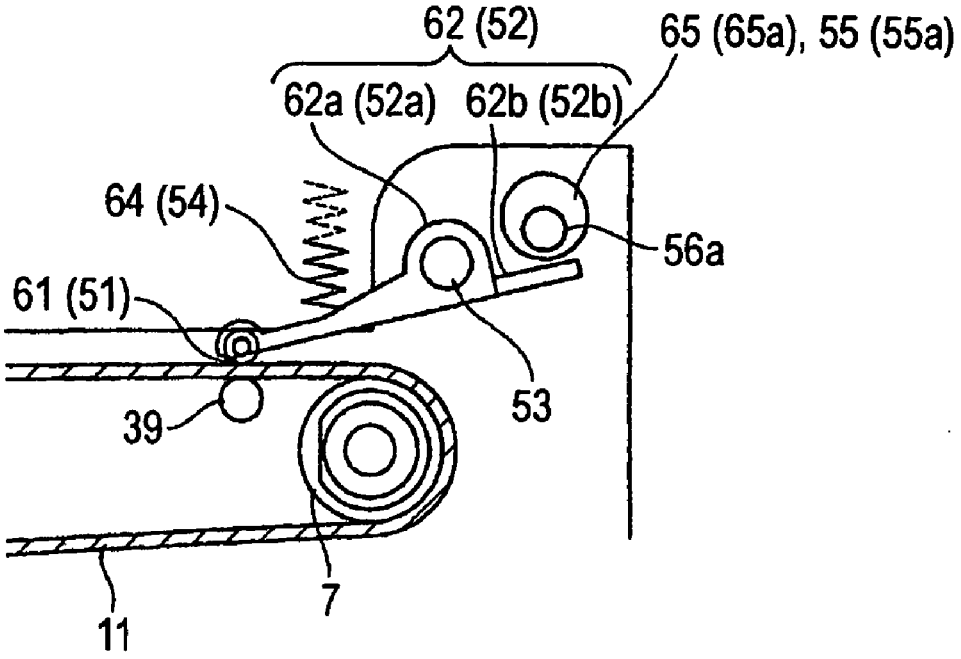
FIGS. 5A and 5B are views showing operating states of a releasing mechanism shown in FIG. 1.
Figure 5B:
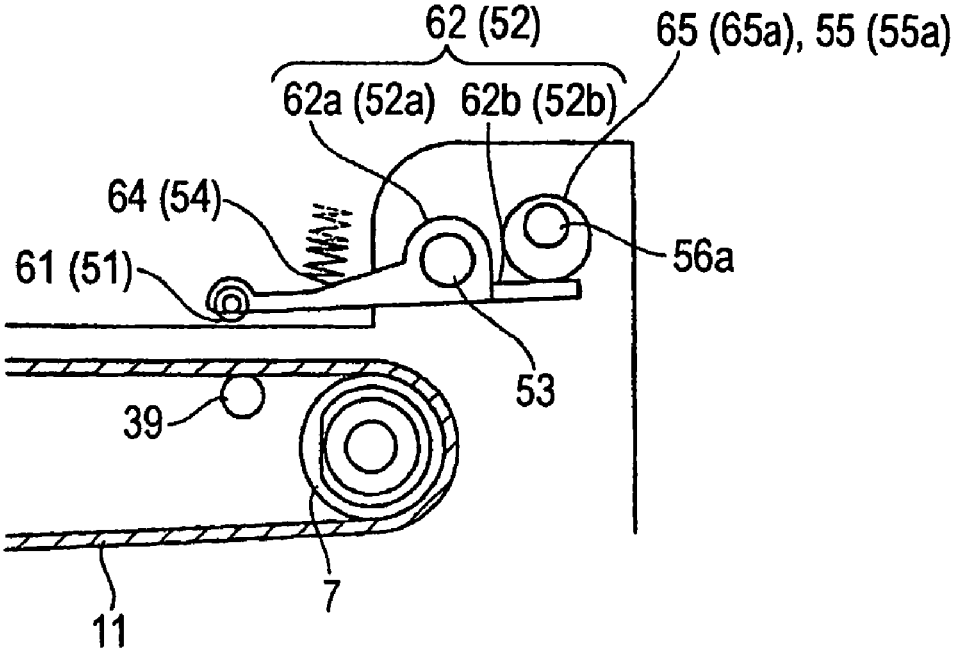

The releasing mechanism 55 releases the contact between each of the encoder nip rollers 51 and the conveyance belt 11. In the releasing mechanism 55, an eccentric cam 55*a* is mounted on a rotating shaft 56*a* of a cam motor 56 and is rotated by driving the cam motor 56. The outer circumferential surface (cam surface) of the eccentric cam 55*a* faces a portion of the connecting member 52*b* of the roller-supporting member 52, which is opposite to the biasing spring 54 with respect to the pivot shaft 53. An operation of the releasing mechanism 55 will be described with reference to FIG. 5. FIG. 5A shows a state in which the releasing mechanism 55 does not release the contact between each of the encoder nip rollers 51 and the conveyance belt 11. FIG. 5B shows a state in which the releasing mechanism 55 releases the contact between each of the encoder nip rollers 51 and the conveyance belt 11.

As shown in FIG. 5A, when the eccentric cam 55*a* stops at a rotation position where the eccentric cam 55*a* does not come into contact with the roller-supporting member 52, the roller-supporting member 52 swings due to a biasing force of the biasing spring 54 so that each of the encoder nip rollers 51 comes close to the encoder roller 39. Accordingly, each of the encoder nip rollers 51 comes into contact with the conveyance belt 11, and each of the encoder nip rollers 51 and the encoder roller 39 nip the conveyance belt 11 therebetween. As shown in FIG. 5B, when the eccentric cam 55*a* stops at a rotation position where the eccentric cam 55*a* comes into contact with the roller-supporting member 52, the eccentric cam 55*a* presses the roller-supporting member 52. Accordingly, the roller-supporting member 52 swings so that each of the encoder nip rollers 51 is separate from the encoder roller 39. Thereby, each of the encoder nip rollers 51 is separate from the conveyance belt 11.

Returning to FIGS. 2 and 3, the paper nip biasing mechanism 60 supports the paper nip roller 61 so that the paper nip roller 61 faces the encoder roller 39 through the conveyance belt 11 while being positioned in the paper passing region 27. In addition, the paper nip biasing mechanism 60 includes a roller-supporting member 62 for supporting the paper nip roller 61, and a releasing mechanism 65 for releasing contact between the paper nip roller 61 and the conveyance belt 11. The roller-supporting member 62 includes a pair of holding arms 62*a* and a connecting member 62*b*. The holding arms 62*a* can swing about the pivot shaft 53, and rotatably support both ends of the paper nip roller 61 at both ends thereof. The connecting member 62*b* is provided between a pair of holding arms 62*a* to connect them to each other. A biasing spring 64 is mounted between the connecting member 62*b* and the frame (not shown) so as to bias the paper nip roller 61 in a direction coming close to the encoder roller 39. When the roller-supporting member 62 swings so that the paper nip roller 61 comes close to the encoder roller 39, the paper nip roller 61 comes into contact with the conveyance belt 11 in the paper passing region 27 and the paper nip roller 61 and the encoder roller 39 nip the conveyance belt 11 therebetween (see FIG. 5). In this manner, when the paper nip roller 61 and the encoder roller 39 nip the sheet of print paper P and the conveyance belt 11 therebetween, the sheet of print paper P reliably adheres to the adhesive layer 36. Furthermore, the paper nip roller 61, which comes into contact with the conveyance belt 11, and the pair of the encoder nip rollers 51, which comes into contact with the conveyance belt 11 as well are disposed coaxially (i.e., a center axis of the paper nip roller 61 and center axes of the encoder nip rollers 51 are located on the same line). Moreover, a biasing force of the biasing spring 64 of the paper nip biasing mechanism 60 is smaller than that of the biasing spring 54 of each encoder nip biasing mechanism 50.

The releasing mechanism 65 has the same structure as the releasing mechanism 55. An eccentric cam 65*a* is mounted on the rotating shaft 56*a* of the cam motor 56. The outer circumferential surface (cam surface) of the eccentric cam 65*a* faces a portion of the roller-supporting member 62, which is opposite to the paper nip roller 61 with respect to the pivot shaft 63. Since the operation of the releasing mechanism 65 is substantially the same as that of the releasing mechanism 55, description thereof will be omitted.

Figure 6:
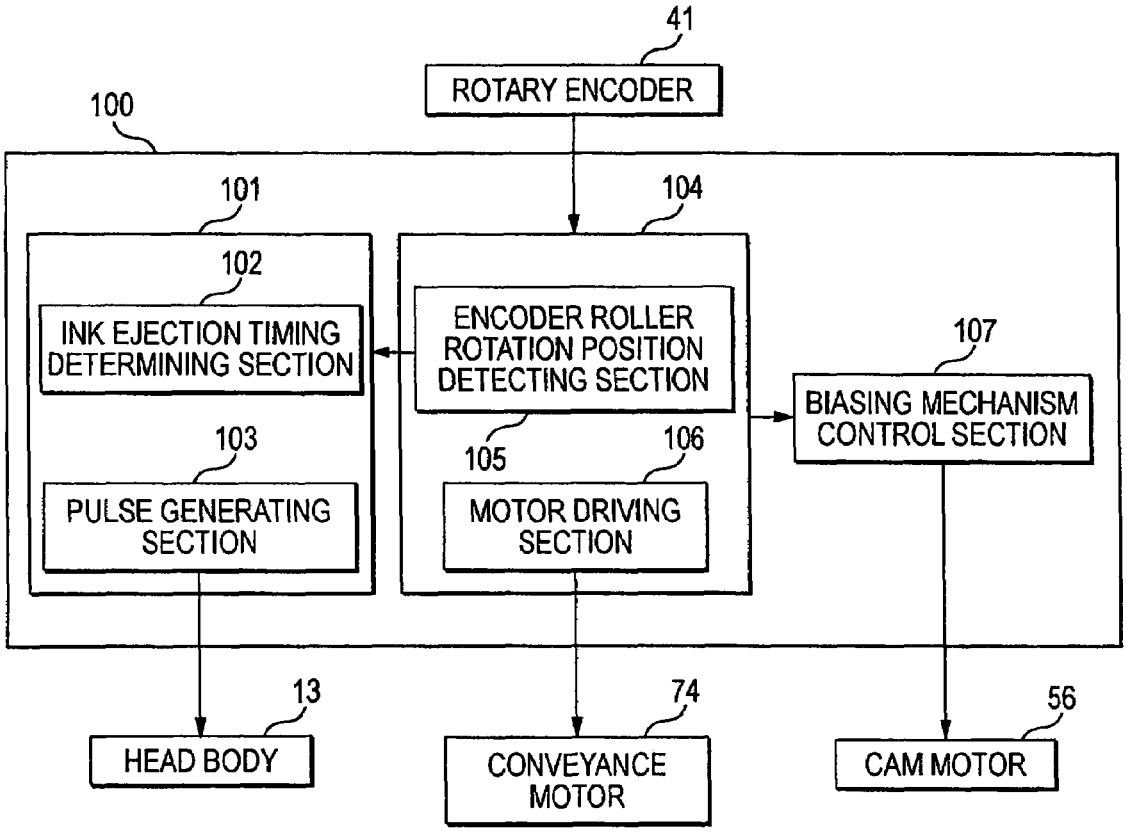
FIG. 6 is a functional block diagram of the control unit shown in FIG. 1.

Next, the control unit 100 will be described with reference to the FIG. 6. FIG. 6 is a functional block diagram of the control unit 100. The control unit 100 includes a CPU (Central Processing Unit) serving as an arithmetic processing unit, a ROM (Read Only Memory) for storing programs executed by the CPU and data used in the programs, a RAM (Random Access Memory) for temporarily storing data during the execution of the programs, and other logic circuits. These components operate in conjunction with each other to construct functional sections described below.

As shown in FIG. 6, the control unit 100 includes a head control section 101 for controlling the ejection of ink from each inkjet head 2, a motor control section 104 for controlling the driving of the conveyance motor 74, and a biasing mechanism control section 107 for controlling each encoder nip biasing mechanism 50 and the paper nip biasing mechanism 60. Further, even though each of these functional sections is hardware configured by the ASIC (Application Specific Integrated Circuit) or the like, all of the functional sections or a part of the functional sections may be implemented by software.

The head control section 101 includes an ejection timing determining section 102 and a pulse generating section 103. The ejection timing determining section 102 controls an ejection timing of an ink to be ejected by the inkjet heads 2, on the basis of image data to be formed on the sheet of print paper P. In addition, to correct positional deviation of the conveyance belt 11, the ejection timing determining section 102 changes the ejection timing on the basis of a rotation position of the encoder roller 39, which is detected by the encoder roller rotation position detecting section 105 (described below). The pulse generating section 103 generates a driving pulse for driving each of the head bodies 13 according to the ink ejection timing, which is determined by the ejection timing determining section 102, and provide the generated driving pulse to each of the head bodies 13. Whenever the driving pulse is provided from the pulse generating section 103, the head body 13 ejects inks onto the sheet of print paper P.

The motor control section 104 includes the encoder roller rotation position detecting section 105 and a motor driving section 106. The encoder roller rotation position detecting section 105 detects the rotation position of the encoder roller 39 on the basis of a detecting result from the optical sensor 41*b* of the rotary encoder 41. The position or the rotation speed of the conveyance belt 11 can be detected by detecting the rotation position of the encoder roller 39. The motor driving section 106 drives the conveyance motor 74 on the basis of the rotation position of the encoder roller 39, which is detected by the encoder roller rotation position detecting section 105.

A biasing mechanism control section 107 drives the releasing mechanisms 55 of the each encoder nip biasing mechanisms 50 and the releasing mechanism 65 of the paper nip biasing mechanism 60 by controlling the driving of the cam motor 56. Specifically, the biasing mechanism control section 107 controls the releasing mechanisms 55 and the releasing mechanism 65 in conjunction with the motor control section 104 and the paper sensor 33 so that the contact between each of the encoder nip rollers 51 and the conveyance belt 11 and the contact between the paper nip roller 61 and the conveyance belt 11 are released only when the sheet of print paper P is not placed on the conveyance belt 11. That is, in the case of controlling the releasing mechanisms 55 and the releasing mechanism 65 so that each of the encoder nip rollers 51 and paper nip roller 61 come into contact with the conveyance belt 11, the biasing mechanism control section 107 drives the cam motor 56 so that the eccentric cam 55*a* of the releasing mechanism 55 does not come into contact with the roller-supporting member 52 and the eccentric cam 65*a* of the releasing mechanism 65 does not come into contact with the roller-supporting member 62. Moreover, in the case of controlling the releasing mechanism 55 and the releasing mechanism 65 so as to release the contact between each of the encoder nip rollers 51 and the conveyance belt 11 and the contact between the paper nip roller 61 and the conveyance belt 11, the biasing mechanism control section 107 drives the cam motor 56 so that the eccentric cam 55*a* of the releasing mechanism 55 comes into contact with the roller-supporting member 52 and the eccentric cam 65*a* of the releasing mechanism 65 comes into contact with the roller-supporting member 62 (see FIGS. 5A and 5B).

In the first embodiment described above, each of the encoder nip rollers 51 is configured so as to come into contact with the conveyance belt 11 only in the paper non-passing region 28. Therefore, the sheet of print paper P does not pass through between each of the encoder nip rollers 51 and the conveyance belt 11. As a result, regardless of whether the sheet of print paper P is placed on the conveyance belt 11, it is possible to press each of the encoder nip rollers 51 against the conveyance belt 11 at a constant pressure at any time. That is, it is possible that each of the encoder nip rollers 51 and the encoder roller 39 nip the conveyance belt 11 at a contact pressure at any time. Accordingly, it is possible to accurately detect the moving speed of the conveyance belt 11 from the rotation position of the encoder roller 39. In addition, the ejection timing determining section 102 of the head control section 101 controls the ink ejection timing to correct the positional deviation of the conveyance belt 11 on the basis of the rotation position of the encoder roller 39, which is detected by the encoder roller rotation position detecting section 105. Therefore, it is possible to accurately and quickly correct unusual variation occurring in the conveyance belt 11.

Furthermore, the paper nip roller 61 is configured so as to come into contact with the conveyance belt 11 in the paper passing region 27. Accordingly, when the sheet of print paper P passes through between the paper nip roller 61 and the conveyance belt 11, the paper nip roller 61 and the encoder roller 39 nip the sheet of print paper P and the conveyance belt 11 therebetween. As a result, the sheet of print paper P reliably adheres to the adhesive layer 36. Thereby, it is possible to prevent the sheet of print paper P from being lifted from the conveyance belt 11.

In addition, the paper passing region 27 is arranged symmetrically with respect to a center of the conveyance belt 11 in the width direction that is perpendicular to a direction in which the conveyance belt 11 moves. Accordingly, when the sheet of print paper P is conveyed, weight is applied to the conveyance belt 11 uniformly. Therefore, the conveyance belt 11 hardly meanders, and it is possible to more accurately detect the moving speed of the conveyance belt 11.

Moreover, the paper nip roller 61, which comes into contact with the conveyance belt 11, is disposed coaxially with respect to the pair of encoder nip rollers 51, which come into contact with the conveyance belt 11 as well. The encoder roller 39 faces the paper nip roller 61 as well as the encoder nip rollers 51. Therefore, it is possible to reduce the number of rollers and manufacturing cost. In addition, at the moment when the sheet of print paper P enters between the paper nip roller 61 and the conveyance belt 11 and the moment when the sheet of print paper P is discharged from between the paper nip roller 61 and the conveyance belt 11, the encoder nip rollers 51 can efficiently reduce unusual variation occurring in the conveyance belt 11. Furthermore, since the encoder nip rollers 51 uniformly apply the weight on both sides of the conveyance belt 11 in the width direction (in the direction perpendicular to the paper conveyance direction), the conveyance belt 11 hardly meanders.

Moreover, when the sheet of print paper P is not placed on the conveyance belt 11, the biasing mechanism control section 107 releases the contact between each of the encoder nip rollers 51 and the conveyance belt 11 and the contact between the paper nip roller 61 and the conveyance belt 11. Accordingly, an excessive frictional force is not applied to the conveyance belt 11, and a load applied to the conveyance belt 11 can be reduced.

The biasing force of the biasing spring 64*b* of the paper nip biasing mechanism 60 is smaller than that of the biasing springs of the encoder nip biasing mechanisms 50. Therefore, at the moment when the sheet of print paper P enters between the paper nip roller 61 and the conveyance belt 11 and the moment when the sheet of print paper P is discharged from between the paper nip roller 61 and the conveyance belt 11, unusual variation occurring in the conveyance belt 11 can be made relatively small. In addition, if a biasing force of the biasing spring 54 is sufficiently large, even though unusual variation occurs, following property of the encoder roller 39 does not deteriorate, and it is possible to more accurately detect the rotation speed of the conveyance belt 11.

Furthermore, since each of the inkjet heads 2 is a line type inkjet head extending in the direction perpendicular to the paper conveyance direction, it is possible to further increase the conveyance speed of the sheet of print paper P in comparison with the serial type inkjet head scanning in the direction perpendicular to the paper conveyance direction. Thereby, it is possible to enhance printing speed.

Figure 7:
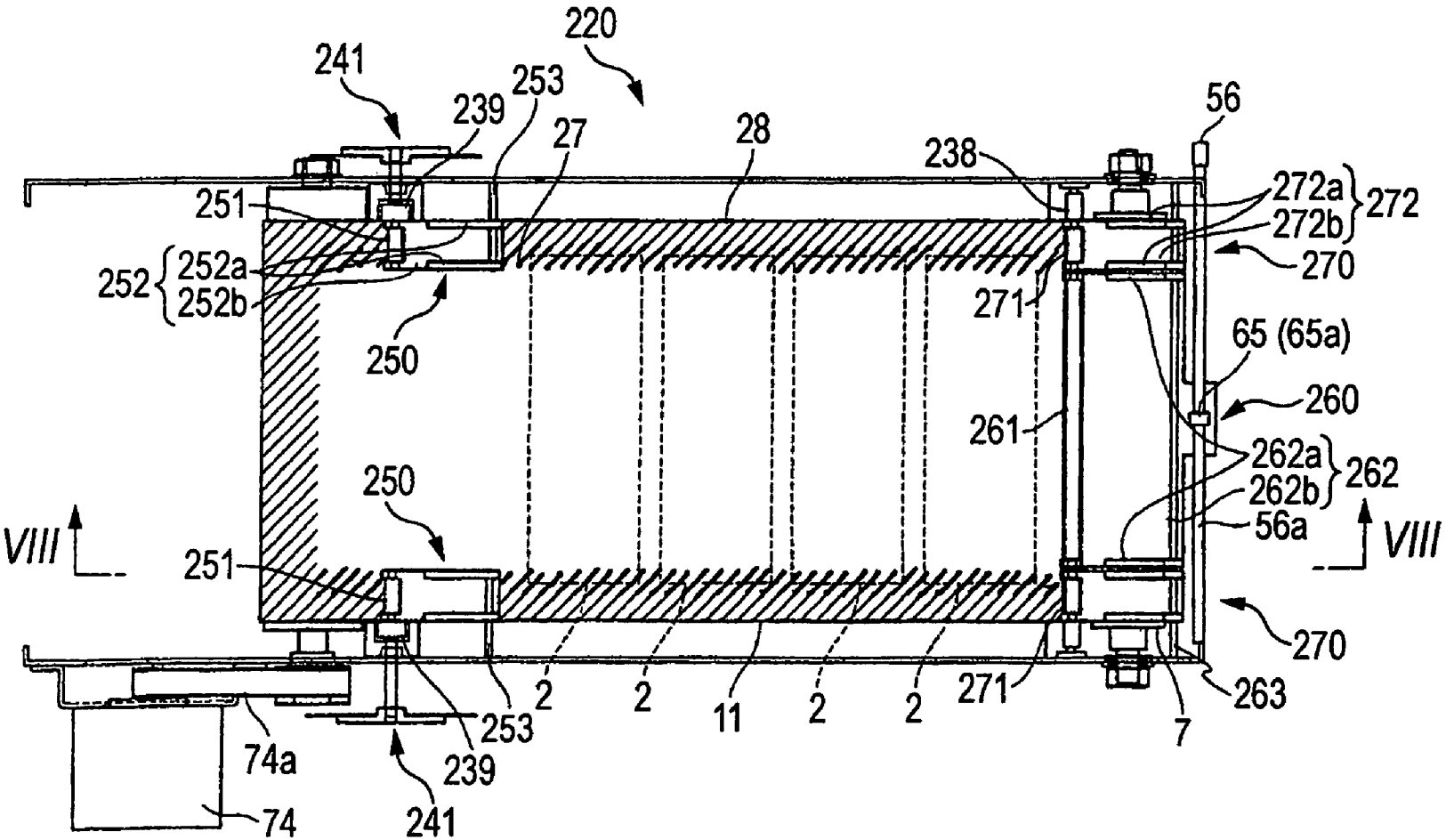
FIG. 7 is a plan view showing a paper conveyance apparatus, which is included in a printer according to a second embodiment of the invention.
Figure 8:
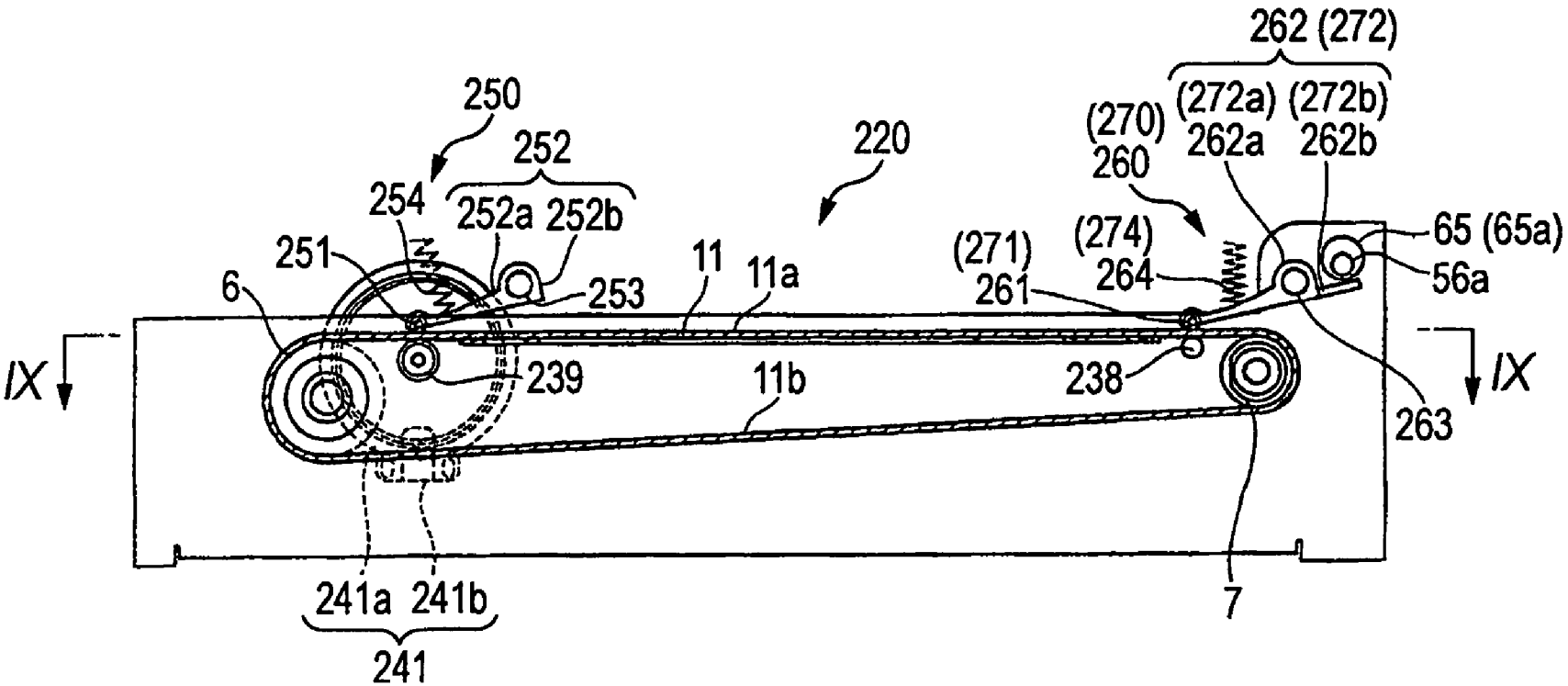
FIG. 8 is a section view taken along line VIII-VIII shown in FIG. 7.
Figure 9:
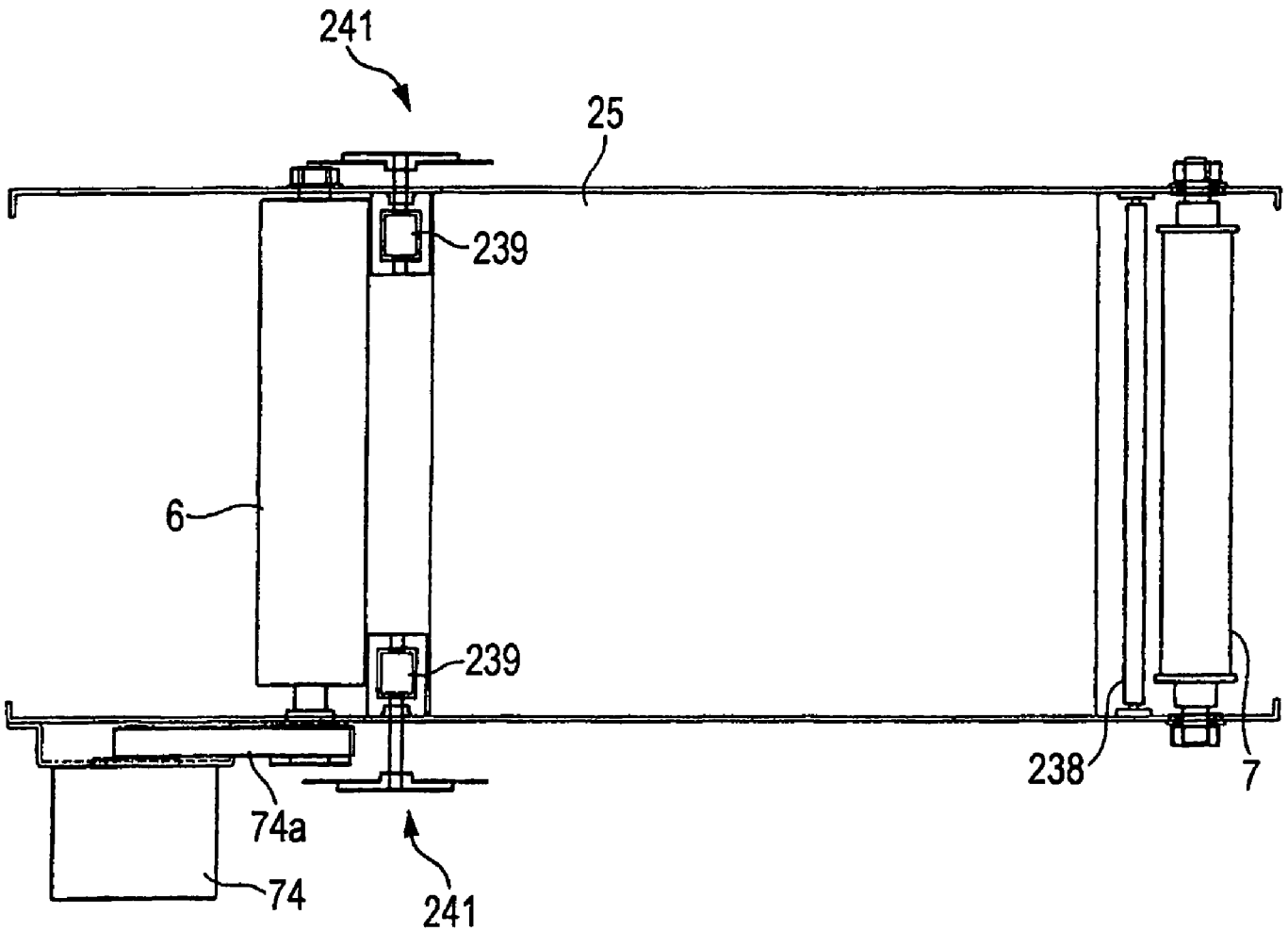
FIG. 9 is a section view taken along line IX-IX shown in FIG. 7.

Next, a second embodiment according to the invention will be described with reference to the drawings. The same reference numerals are assigned to the same elements as the first embodiment, and the detailed description thereof will be omitted. FIG. 7 is a plan view showing a paper conveyance apparatus 220, which is included in the inkjet printer according to the second embodiment. FIG. 8 is a section view taken along a line VIII-VIII shown in FIG. 7. FIG. 9 is a section view taken along a line IX-IX shown in FIG. 8.

As shown in FIGS. 7 to 9, similarly to the first embodiment, the paper conveyance apparatus 220 includes a conveyance belt 11, belt rollers 6 and 7, a conveyance motor 74, two encoder rollers 239 (serving as a first roller), two rotary encoders 241, encoder nip rollers 251 (serving as a second roller), two encoder nip biasing mechanisms 250 (serving as a first biasing mechanism), a paper roller 238 (serving as third and fifth rollers), a paper nip roller 261 (serving as a fourth roller) and a paper nip biasing mechanism 260 (serving as a second biasing mechanism). The conveyance belt 11 has a base layer 35 and an adhesive layer 36. The adhesive layer 36 is coated on the whole outer circumferential surface of a base layer 35. The two encoders 241 each detect rotation positions of the two encoder rollers 239. The encoder nip biasing mechanisms 250 supports the encoder nip rollers 251 and each biases the encoder nip rollers 251 in a direction coming close to the encoder rollers 239. The paper nip biasing mechanism 260 supports the paper nip roller 261 and biases the paper nip roller 261 in a direction coming close to the paper roller 238. In addition, the paper conveyance apparatus 220 further includes load nip rollers 271 (serving as a sixth roller) and two load nip biasing mechanisms 270 for biasing the load nip rollers 271 in the direction approaching the paper roller 238 are further included in the present embodiment.

As shown in FIGS. 7 and 8, each of the two encoder rollers 239 has a length in a shaft direction so that each of the encoder rollers 239 is in contact with only the inner circumferential surface 11*b* of the conveyance belt 11 corresponding to the paper non-passing region 28 on both sides in the width direction. The rotary encoders 241 are provided at the ends of the encoder rollers 239, respectively. Each of the rotary encoders 241 includes a disk-shaped slip plate 241*a* having a plurality of slits in the outer edge thereof and an optical sensor 241*b* for detecting the slits of the slip plate 241*a*. When each of the encoder rollers 239 rotates, each of the slit plates 241*a* mounted thereon is also rotated. When each of the slit plates 241*a* rotates at a predetermined angle, each of the optical sensors 241*b* detects that light passes through the slits formed in each of the slit plates 241*a*. Then, each of the optical sensors 241*b* outputs a detection signal to a control unit 100. The control unit 100 controls an ink ejection timing from the inkjet heads 2 and controls the conveyance motor 74 on the basis of the detecting signal from the two optical sensors 241*b* so as to compensate the difference between the rotation positions of the encoder rollers 239.

The paper roller 238 extends across the conveyance belt 11 along the width direction of the conveyance belt 11, and comes into contact with the inner circumferential surface 11*b* of the conveyance belt 11.

As shown in FIGS. 7 and 9, each of the two encoder nip biasing mechanisms 250 supports each of the encoder nip rollers 251 so that each of the encoder nip rollers 251 faces each of the encoder rollers 239 through the conveyance belt 11 while being positioned in the paper non-passing region 28. In addition, each of the encoder nip biasing mechanisms 250 includes a roller-supporting member 252 for supporting each of the encoder nip rollers 251. Each of the encoder nip rollers 251 has a length in its shaft direction shorter than a length of each of the encoder rollers 239 in its shaft direction. The encoder nip biasing mechanisms 250 always bias the encoder nip rollers 251 so as to be in contact with the conveyance belt 11. If it is necessary to release contact between the encoder nip rollers 251 and the conveyance belt 11, eccentric cams may be employed as in the first embodiment. The roller-supporting member 252 includes a pair of holding arms 252*a* and a connecting member 252*b*. The holding arms 252*a* can swing about a pivot shaft 253, which has both ends fixed to a frame along a width direction of the conveyance belt 11, and rotatably supports both ends of each of the encoder nip roller 251 at ends thereof. The connecting member 252*b* is provided between a pair of the holding arms 252*a* to connect them to each other. A biasing spring 254 is mounted between the connecting member 252*b* and the frame (not shown) so as to bias each of the encoder nip roller 251 in a direction coming close to each of the encoder rollers 239. The two encoder nip rollers 251 independently come into contact with the both sides of the conveyance belt 11, in the width direction, corresponding to the paper non-passing region 28, respectively.

The paper nip biasing mechanism 260 supports the paper nip roller 261 so that the paper nip roller 261 faces the paper roller 238 through the conveyance belt 11 while being positioned in the paper passing region 27. In addition, the paper nip biasing mechanism 260 includes a roller-supporting member 262 for supporting the paper nip roller 261, and a releasing mechanism 65 for releasing contact between the paper nip roller 261 and the conveyance belt 11. The roller-supporting member 262 includes a pair of holding arms 262*a* and a connecting member 262*b*. The holding arms 262*a* can swing about a pivot shaft 263, which has both ends fixed to a frame along a width direction of the conveyance belt 11, and rotatably support both ends of the paper nip roller 261 at the ends thereof. The connecting member 262*b* is provided between the pair of holding arms 262*a* to connect them to each other. A biasing spring 264 is mounted between the connecting member 262*b* and the frame (not shown) so as to bias the paper nip roller 261 in a direction coming close to the paper roller 238. When the roller-supporting member 262 swings so that the paper nip roller 261 comes close to the paper roller 238, the paper nip roller 261 comes into contact with the conveyance belt 11 in the paper passing region 27 and the paper nip roller and the paper roller 238 nip the conveyance belt 11 therebetween. In this manner, when the paper nip roller 261 and the paper roller 238 nip the sheet of print paper P and the conveyance belt 11 therebetween, the sheet of print paper P reliably adheres to the adhesive layer 36.

Each of the two load nip biasing mechanisms 270 supports each of the load nip rollers 271 so that each of the load nip rollers 271 faces the paper roller 238 through the conveyance belt 11 while being positioned in the paper non-passing region 28. In addition, each of the two load nip biasing mechanisms 270 includes a roller-supporting member 272 for supporting the load nip roller 271. The roller-supporting member 272 includes a pair of holding arms 272*a* and a connecting member 272*b*. The holding arms 272*a* can swing about a pivot shaft 263, and rotatably support both ends of the load nip roller 271 at ends thereof. The connecting member 272*b* is provided between the pair of holding arms 272*a* to connect them to each other. A biasing spring 274 is mounted between the connecting member 272*b* and the frame (not shown) so as to bias the load nip roller 271 in a direction coming close to the paper roller 238. When the roller-supporting member 272 swings so that the load nip rollers 271 come close to the paper roller 238, each of the load nip rollers 271 comes into contact with the conveyance belt 11 in the paper non-passing region 28 and the load nip rollers 271 and the paper roller 238 nip the conveyance belt 11 therebetween. That is, each of the two load nip rollers 271 independently comes into contact with the conveyance belt 11 in the paper non-passing region 28, respectively. In this case, the two load nip rollers 271, which come into contact with the conveyance belt 11, and the paper nip roller 261, which come into contact with the conveyance belt 11 as well, are disposed coaxially.

In the second embodiment described above, each of the encoder nip rollers 251 is configured so as to be in contact with the conveyance belt 11 in the paper non-passing region 28. Therefore, the sheet of print paper P does not pass through between each of the encoder nip rollers 251 and the conveyance belt 11. As a result, regardless of whether the sheet of print paper P is placed on the conveyance belt 11, it is possible to press each of the encoder nip rollers 251 against the conveyance belt 11 at a constant pressure at any time. That is, it is possible that each of the encoder nip rollers 251 and the encoder roller 239 nip the conveyance belt 11 at a constant pressure at anytime. Accordingly, it is possible to accurately detect the moving speed of the conveyance belt 11 from the rotation position of the encoder roller 239.

Further, since each of the encoder nip rollers 251 has a length in the shaft direction shorter than each of the encoder rollers 239, inertia of each of the encoder nip rollers 251 is reduced and responsiveness with respect to the behavior of the conveyance belt 11 is improved. In addition, each of the two encoder rollers 239 has a length in the shaft direction so that each of the encoder rollers 239 comes into contact with only the inner circumferential surface 11*b* of the conveyance belt 11 corresponding to the paper non-passing region 28 on both sides in the width direction. In other words, the length of each encoder roller 239 in the shaft direction is shorter than that of the conveyance belt 11 in the width direction that is parallel to the shaft direction. Therefore, the inertia of each of the encoder roller 239 is reduced and responsiveness with respect to the behavior of the conveyance belt 11 is further improved.

Moreover, the paper nip roller 261 is disposed between the pair of load nip rollers 271 and is disposed coaxially with the load nip rollers 271. Since the paper roller 238 faces the load nip rollers 271 as well as the paper nip roller 261, it is possible to reduce the number of rollers and manufacturing cost. In addition, at the moment in which the sheet of print paper P enters between the paper nip roller 261 and the conveyance belt 11 and at the moment in which the sheet of print paper P is discharged from between the paper nip roller 261 and the conveyance belt 11, the load nip rollers 271 can efficiently reduce unusual variation occurring in the conveyance belt 11. Furthermore, since the load nip rollers 271 uniformly apply the weight on both sides of the conveyance belt 11 in the width direction (in the direction perpendicular to the paper conveyance direction), the conveyance belt 11 hardly meanders.

Moreover, combinations of the encoder roller 239 and the encoder nip roller 251 are provided on both sides of the conveyance belt 11 in the width direction, weight is uniformly applied on the both sides of the conveyance belt 11 in the width direction. Thereby, the conveyance belt 11 hardly meanders.

In addition, the rotary encoders 241 are provided to correspond to the two encoder rollers 239, and the control unit 100 corrects the difference between the rotation positions of the two encoder rollers 239 on the basis of the detecting result from the two optical sensors 241*b*. Accordingly, it is possible to more accurately detect the moving speed of the conveyance belt 11.

Further, since the load nip biasing mechanisms 270 are provided, variable ratio of load applied to the conveyance belt 11 is reduced when the sheet of print paper P passes through between the paper nip roller 261 and the conveyance belt 11. As a result, it is possible to more accurately detect the moving speed of the conveyance belt 11.

Figure 10:
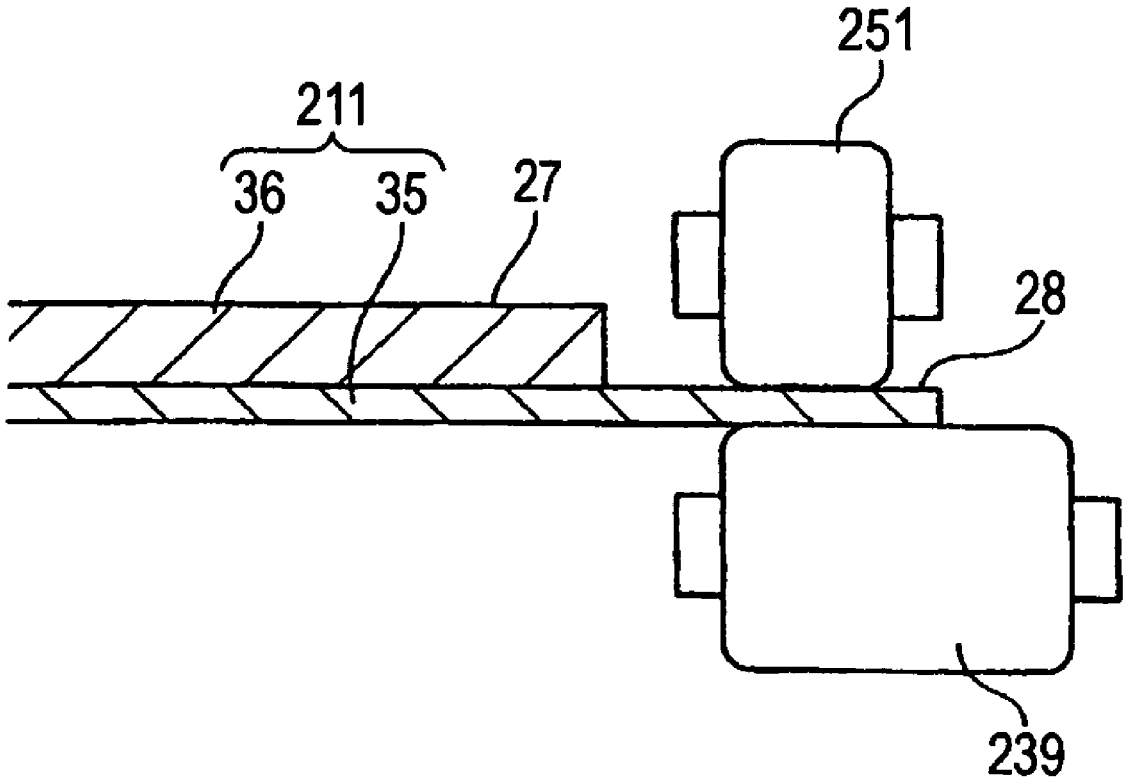
FIG. 10 is a view showing a modification of the paper conveyance apparatus shown in FIG. 7.

Next, a modification of the second embodiment will be described with reference to FIG. 10. FIG. 10 shows a modification of the conveyance belt 11. In the second embodiment, the whole outer circumferential surface 11*a* of conveyance belt 11 is coated with the adhesive layer 36. However, as show in FIG. 10, on the both ends of the conveyance belt 211 corresponding to the paper non-passing region, a base layer 35 may be exposed without the adhesive layer 36 coated thereon. In this structure, the encoder roller 239 and the encoder nip roller 251 nip the base layer 35 therebetween with the encoder nip roller 251 contacting the front face formed by the base layer 35. According to this structure, since each of the encoder nip rollers 251 comes into contact with the base layer 35, which is more hardly deformed than the adhesive layer 36, a biasing force by each encoder nip roller 251 is transmitted more efficiently to each of the encoder rollers 239. As a result, it is possible to know a position of the conveyance belt 211 more accurately.

Figure 11:
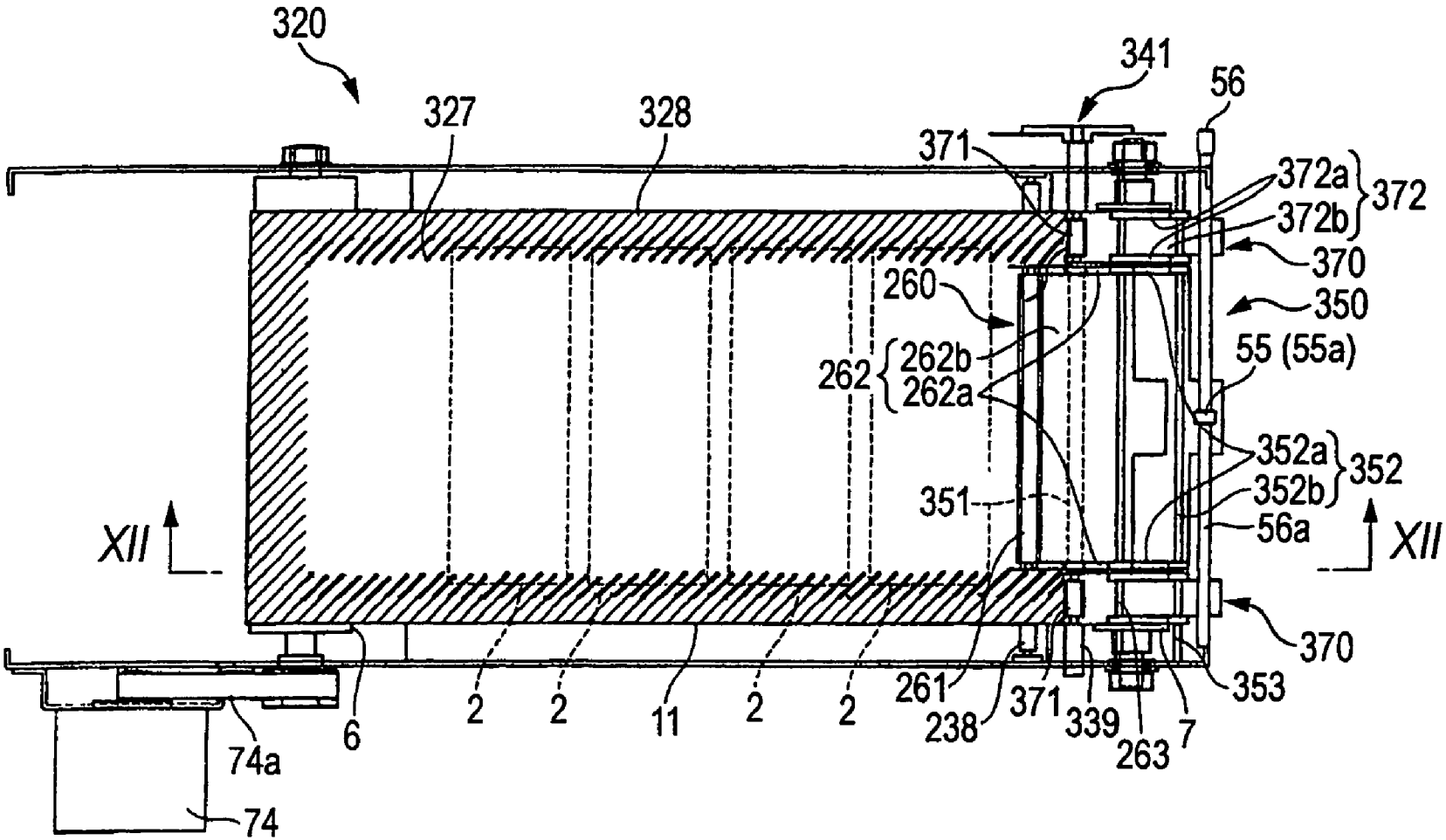
FIG. 11 is a plan view showing a paper conveyance apparatus, which is included in a printer according to a third embodiment of the invention.
Figure 12:
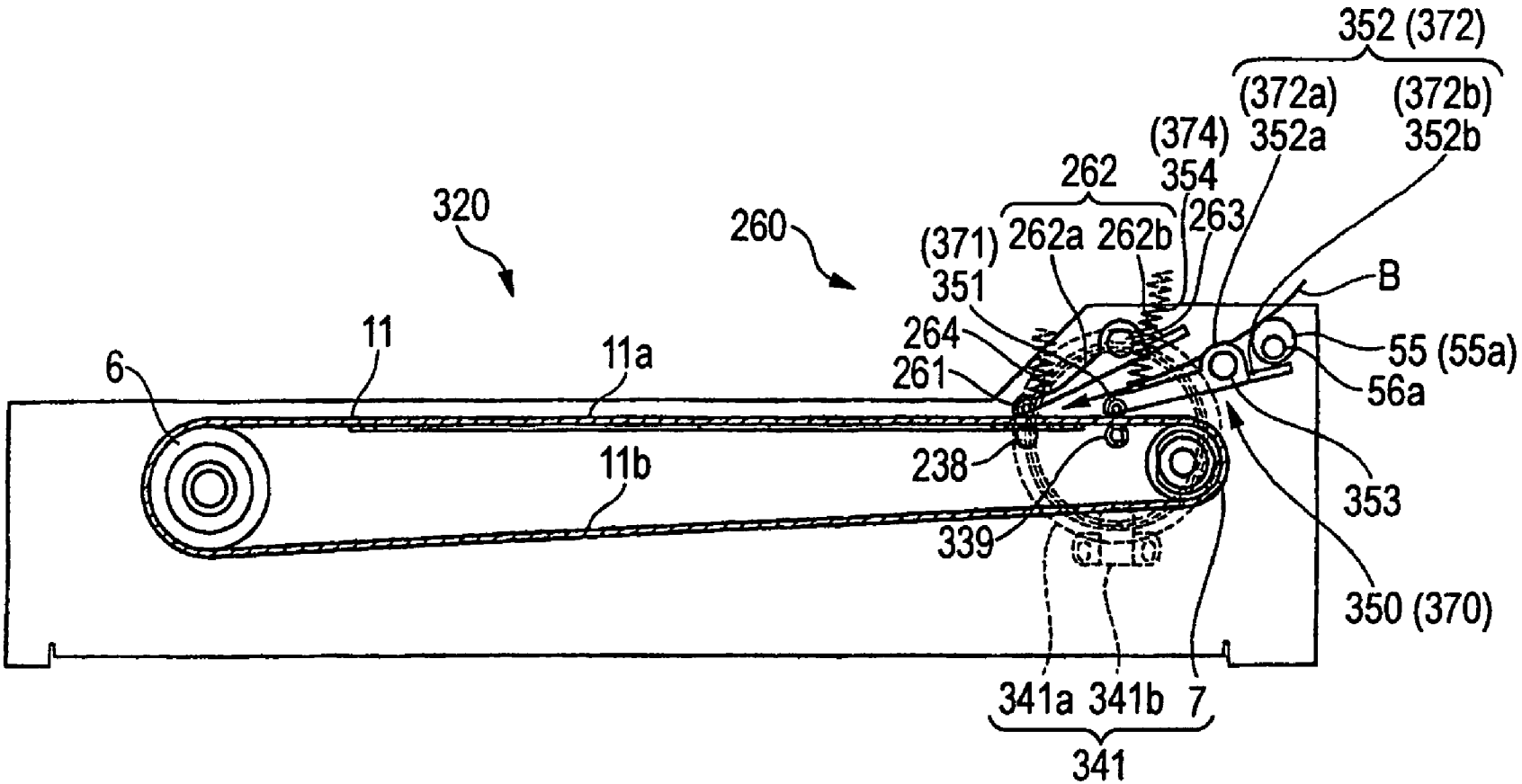
FIG. 12 is a section view taken along line XII-XII shown in FIG. 11.
Figure 13:
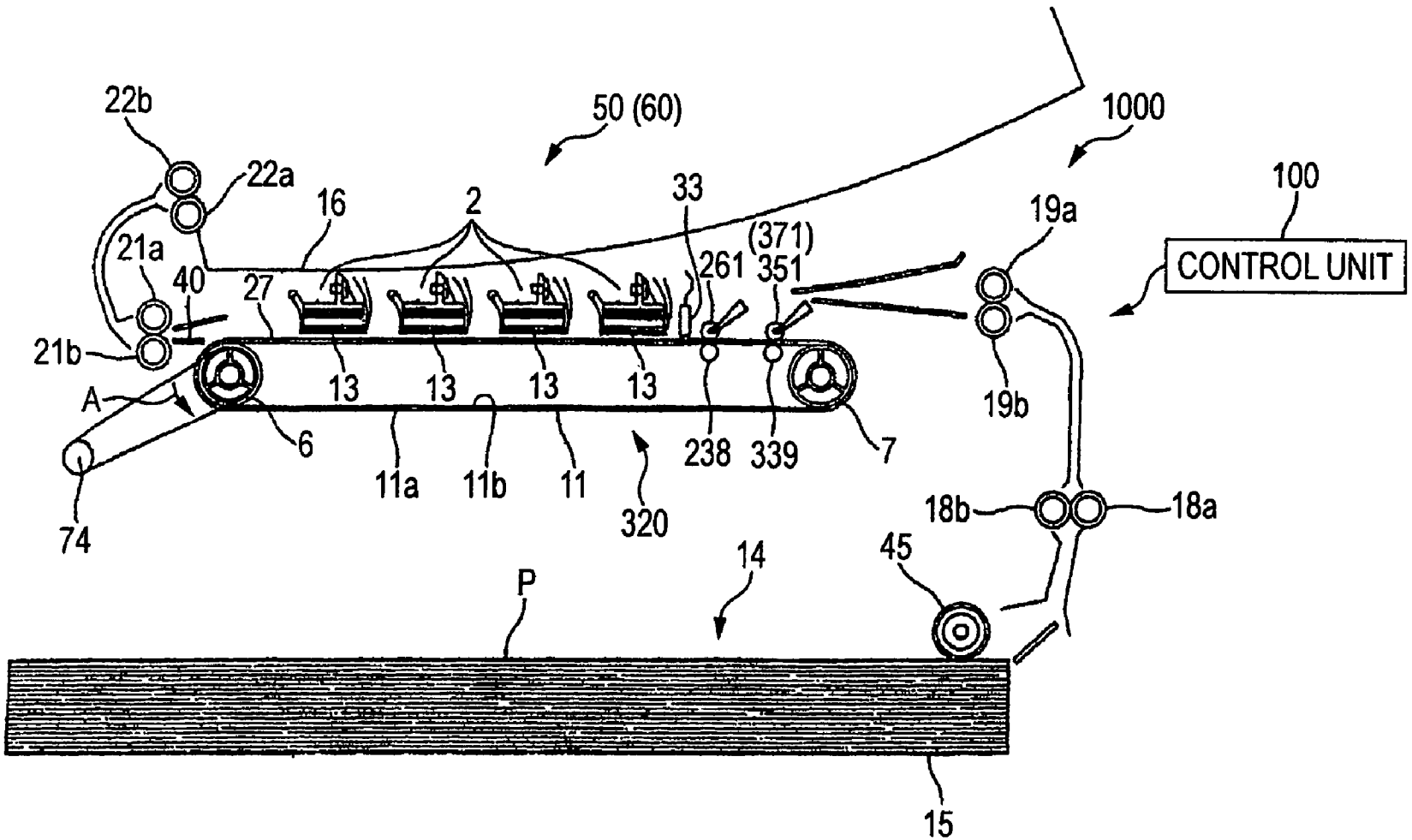
FIG. 13 is a schematic view showing an inkjet printer according to the third embodiment.

Next, a third embodiment according to the invention will be described with reference to the drawings. The same reference numerals are assigned to the same elements as the first embodiment and the second embodiment, and the detailed description thereof will be omitted. FIG. 11 is a plan view showing a paper conveyance apparatus 320, which is included in the inkjet printer according to the third embodiment. FIG. 12 is a section view taken along line XII-XII shown in FIG. 11. FIG. 13 is a schematic view showing an inkjet printer 1000 according to the third embodiment.

As shown in FIGS. 11 to 13, the paper conveyance apparatus 320 includes a conveyance belt 11, belt rollers 6 and 7, a conveyance motor 74, an encoder roller 339, a rotary encoder 341, an encoder nip roller 351, an encoder nip biasing mechanism 350, a paper roller 238, a paper nip mechanism 260, load nip rollers 371 and two load nip biasing mechanisms 370. The rotary encoder 341 detects a rotation position of the encoder roller 339. The encoder nip biasing mechanism 350 supports the encoder nip roller 351 and biases the encoder nip roller 351 in a direction coming close to the encoder roller 339. The load nip biasing mechanisms 370 support the load nip rollers 371 and bias the load nip rollers 371 so as to come close to the encoder roller 339.

In this embodiment, the encoder nip roller 351 comes into contact with the middle of the conveyance belt 11 in the width direction, and the sheet of print paper P is placed on the conveyance belt 11 from a position on the slightly downstream of the encoder nip roller 351 in the paper conveyance direction. Accordingly, a position where the sheet of print paper P begins to be placed on the conveyance belt 11 corresponds to the most upstream position of the paper passing region 327. Portions of the conveyance belt 11 on the upstream of the encoder nip roller 351 correspond to the paper non-passing region 328. The structure of the encoder nip roller 351 will be described below.

The encoder roller 339 extends across the conveyance belt 11 along the width direction of the conveyance belt 11. The encoder roller 339 is in contact with a portion of the inner circumferential surface 11*b* of the conveyance belt 11 corresponding to the paper non-passing region 328, which is more upstream than the most upstream position of the paper passing region 327. The rotary encoder 341 is provided at the end of the encoder roller 339. The rotary encoder 341 includes a disk-shaped slip plate 341*a* having a plurality of slits in the outer edge thereof and an optical sensor 341*b* for detecting the slits of the slip plate 341*a*. Since, the operation of the rotary encoder 341 is substantially the same as that of the rotary encoder 41 according to the first embodiment, the detailed description thereof will be omitted.

The encoder nip biasing mechanisms 350 supports the encoder nip roller 351 to face the encoder roller 339 through the conveyance belt 11. The encoder nip roller 351 is positioned in the middle of the paper non-passing region 328, which is more upstream than the most upstream position of the paper passing region 327, in the width direction of the conveyance belt 11. The encoder nip biasing mechanisms 350 includes a roller-supporting member 352 for supporting the encoder nip roller 351. The roller-supporting member 352 includes a pair of holding arms 352*a* and a connecting member 352*b*. The holding arms 352*a* can swing about a pivot shaft 353, which has both ends fixed to a frame along the width direction of the conveyance belt 11. The holding arms 352*a* rotatably support both ends of the encoder nip roller 351 at ends thereof. The connecting member 352*b* is provided between the pair of holding arms 352*a* to connect the lower ends thereof to each other. Biasing springs 354 are mounted between each of the pair of holding arms 352*a* and a frame (not shown), respectively, so as to bias the encoder nip roller 351 in a direction coming close to the encoder roller 339. When the roller-supporting member 352 swings in the direction where the encoder nip roller 351 comes close to the encoder roller 339, the encoder nip roller 351 abuts against the conveyance belt 11 in the paper non-passing region 328, which is on the upstream of the paper passing region 327, and the encoder nip roller 351 and the encoder roller 339 nip the conveyance belt 11 therebetween. The connecting member 352*b* serves as a guide member, which guides the sheet of print paper P conveyed by the feed rollers 18*a*, 18*b*, 19*a*, and 19*b* onto the most upstream position of the paper passing region 327 on the conveyance belt 11 (see an arrow B in FIG. 12).

Each of the two load nip biasing mechanisms 370 supports each of the load nip rollers 371 so that each of the load nip rollers 371 faces the encoder roller 339 through the conveyance belt 11 while being positioned in the paper non-passing region 328. Since the structure of each load nip biasing mechanism 370 is substantially the same as that of each load nip biasing mechanism 270 of the second embodiment, description thereof will be omitted.

In the third embodiment described above, the encoder nip roller 351 is configured so as to come into contact with the conveyance belt 11 in the paper non-passing region 328. Therefore, the sheet of print paper P does not pass through between the encoder nip roller 351 and the conveyance belt 11. As a result, regardless of whether the sheet of print paper P is placed on the conveyance belt 11, it is possible to press the encoder nip roller 351 against the conveyance belt 11 at a constant pressure at any time. That is, it is possible that the encoder nip roller 351 and the encoder roller 339 nip the conveyance belt 11 at a constant pressure at any time. Accordingly, it is possible to accurately detect the moving speed of the conveyance belt 11 from the rotation position of the encoder roller 339.

In addition, the encoder nip roller 351 and the encoder roller 339 are positioned in the middle of the conveyance belt 11 in the width direction in the paper non-passing region 328, which is on the more upstream than the paper passing region 327. The encoder nip roller 351 may have a length longer than the encoder nip roller of the first and second embodiment. Accordingly, it is possible to increase the contact area between the encoder nip roller 351 and the conveyance belt 11. Thus, the conveyance belt 11 is reliably pressed against the encoder roller 339. For this reason, it is possible to achieve the more accurate moving speed of the conveyance belt 11.

Furthermore, the connecting member 352*b* of the roller-supporting member 352 also serves as a guide member, which guides the sheet of print paper P conveyed by the feed rollers 18*a*, 18*b*, 19*a*, and 19*b* onto the conveyance belt 11. Therefore, it is possible to reduce the number of parts and cost for manufacturing the paper conveyance apparatus 320.

The preferred embodiments of the invention have been described above. However, the invention is not limited to the embodiments described above, and one skilled in the art may recognize various modifications within the scope of the claims. For example, in the first embodiment, each of the encoder nip biasing mechanisms 50 biases each of the encoder nip rollers 51 in the direction of coming close to the encoder roller 39. However, the invention is not limited to such a structure. The encoder roller 39 may be biased in the direction of coming close to the encoder nip roller 51. Alternatively, both the encoder roller 39 and the encoder nip roller 51 may be biased to come close to each other.

Moreover, in the first embodiment, the encoder roller 39 comes into contact with the inner circumferential surface 11*b* of the conveyance belt 11 and the encoder nip roller 51 comes into contact with the outer circumferential surface 11*a* of the conveyance belt 11. However, the encoder roller 39 may come into contact with the outer circumferential surface 11*a* of the conveyance belt 11 and the encoder nip roller 51 may come into contact with the inner circumferential surface 11*b* of the conveyance belt 11.

Further, in the first embodiment, the paper conveyance apparatus 20 may not include the paper nip roller and the paper nip biasing mechanism.

Furthermore, in the first embodiment, the paper passing region 27 is line-symmetric with respect to a center line of the conveyance belt 11 in the width direction that is perpendicular to a direction in which the conveyance belt 11 moves. However, the paper passing region 27 may be deflected to one side of the center line of the conveyance belt 11 in the width direction.

Moreover, in the first embodiment, provided are the releasing mechanism 55 for releasing the contact between the encoder nip roller 51 and the conveyance belt 11 and the releasing mechanism 65 for releasing the contact between the paper nip roller 61 and the conveyance belt 11. However, at least one of the releasing mechanism 55 and the releasing mechanism 65 may be omitted in the first embodiment.

In the first embodiment, a biasing force of the biasing spring 64 of the paper nip biasing mechanism 60 is smaller than that of the biasing spring 54 of each encoder nip biasing mechanism 50. However, the biasing forces of the biasing spring 54 and the biasing spring 64 may be equal to each other. Alternatively, the biasing force of the biasing spring 54 may be smaller than that of the biasing spring 64.

Furthermore, in the first embodiment, each of the inkjet heads 2 is a line type inkjet head. However, each of the inkjet heads may be a serial type inkjet head scanning in the direction perpendicular to the paper conveyance direction of the sheet of print paper P.

Further, in the second embodiment, the rotary encoders 241 are mounted on the two encoder rollers 239, respectively. However, the rotary encoder 241 may be mounted on only one of the two encoder rollers 239. In this case, the other encoder roller 239 serves as an auxiliary roller.

Moreover, in the second embodiment, each of the encoder nip rollers 251 has a length in a shaft direction shorter than each of the encoder rollers 239. However, each of the encoder nip rollers 251 may have a length in shaft direction longer than each of the encoder rollers 239.

Furthermore, in the second embodiment, the paper nip biasing mechanism 260 biases the paper nip roller 261 in the direction coming close to the paper roller 238. However, the paper nip biasing mechanism 260 is not limited to this structure. The paper nip biasing mechanism 260 may bias the paper roller 238 in the direction coming close to the paper nip roller 261. Alternatively, the paper nip biasing mechanism 260 may bias both the paper roller 238 and the paper nip roller 261.

In addition, in the first to the third embodiments, the paper conveyance apparatuses 20, 220, and 320 are applied to the line type printer. However, the paper conveyance apparatuses 20, 220, and 320 are not limited thereto. The paper conveyance apparatuses 20, 220, and 320 can be applied to another apparatus such as a laser printer, a copying machine, etc. so long as the applied apparatus uses a paper conveyance apparatus.

What is claimed is:

1. A paper conveyance apparatus comprising:

an endless type conveyance belt having first and second surfaces, a sheet of paper being to be placed on one of the first and second surfaces;

a driving unit that drives the conveyance belt;

a first roller that is in contact with the first surface of the conveyance belt;

a second roller that is in contact with the second surface of the conveyance belt, the first roller and the second roller nipping the conveyance belt therebetween;

a first biasing mechanism that biases at least one of the first roller and the second roller so that the first roller and the second roller come close to each other; and an encoder that detects a rotation position of the first roller, wherein:

at least one of the first roller and the second roller is in contact with at least one of the first and second surfaces of the conveyance belt in a region outside a paper passing region where a conveyed sheet of paper passes and the first roller and the second roller nip the conveyance belt therebetween only in the region outside the paper passing region.

2. The paper conveyance apparatus according to claim 1, wherein:

the sheet of paper is to be placed on the second surface, the first surface of the conveyance belt is a rear face of the conveyance belt, the second surface of the conveyance belt is a front face of the conveyance belt, and the first biasing mechanism biases the second roller.

3. The paper conveyance apparatus according to claim 1, wherein the second roller is shorter in a shaft direction than the first roller.

4. The paper conveyance apparatus according to claim 1, wherein a length of the first roller in a shaft direction is shorter than that of the conveyance belt in a width direction that is parallel to the shaft direction.

5. The paper conveyance apparatus according to claim 1, wherein the paper passing region is arranged symmetrically with respect to a center of the conveyance belt in a width direction that is perpendicular to a direction in which the conveyance belt moves.

6. The paper conveyance apparatus according to claim 5, wherein a pair of the first roller and the second roller is disposed on each side of the conveyance belt in the width direction.

7. The paper conveyance apparatus according to claim 6, wherein the encoder includes two encoders provided to correspond to the respective first rollers.

8. The paper conveyance apparatus according to claim 1, wherein:

the conveyance belt includes:

a base layer forming the first surface;

an adhesive layer forming the second surface, and a material of the base layer, which is in contact with the first roller, is harder than that of the adhesive layer, which is in contact with the second roller.

9. The paper conveyance apparatus according to claim 1, wherein:

the conveyance belt includes:

a base layer forming the first surface and a part of the second surface;

an adhesive layer that covers a surface of the base layer to form the other parts of the second surface, and the first roller and the second roller nip the base layer therebetween with the second roller contacting the part of the second surface formed by the base layer.

10. The paper conveyance apparatus according to claim 1, further comprising:

a third roller that is in contact with the first surface of the conveyance belt;

a fourth roller that is in contact with the second surface of the conveyance belt in the paper passing region, the third roller and the fourth roller nipping the conveyance belt therebetween; and a second biasing mechanism that biases at least one of the third roller and the fourth roller so that the third roller and the fourth roller come close to each other.

11. The paper conveyance apparatus according to claim 10, wherein:

the second roller includes a pair of second rollers, which are disposed on both sides of the conveyance belt in a width direction independently of each other, the width direction being perpendicular to a direction in which the conveyance belt moves, and the fourth roller is disposed between the pair of second rollers.

12. The paper conveyance apparatus according to claim 11, wherein:

the second rollers and the fourth roller are disposed coaxially to be rotatable independently of each other, and the first roller and the third roller are one and the same roller.

13. The paper conveyance apparatus according to claim 10, further comprising: a guide member disposed at a most upstream position of the paper passing region in a paper conveyance direction, the guide member guiding the sheet of paper to place the sheet of paper on the one of the first and second surfaces, wherein:

the third roller and the fourth roller nip the conveyance belt in the paper passing region, and the first roller and the second roller nip the conveyance belt in a region, which is located more upstream in the paper conveyance direction than the paper passing region.

14. The paper conveyance apparatus according to claim 13, further comprising:

a pair of holding arms that pivot both ends of the second roller, wherein:

the guide member includes a connection member connecting the pair of holding arms.

15. The paper conveyance apparatus according to claim 10, further comprising: a fifth roller; and a sixth roller biased to be in contact with the conveyance belt, wherein:

the fifth roller and the sixth roller nip the conveyance belt therebetween.

16. The paper conveyance apparatus according to claim 15, wherein:

the fourth roller and the sixth roller are disposed coaxially to be rotatable independently of each other, and the third roller and the fifth roller are one and the same roller.

17. The paper conveyance apparatus according to claim 10, further comprising: a controller that controls at least one of the first biasing mechanism and the second biasing mechanism, wherein:

when the conveyance belt does not convey the sheet of paper, the controller controls the at least one of the first biasing mechanism and the second biasing mechanism to release abutment between the conveyance belt and at least one of the second roller and the fourth roller.

18. The paper conveyance apparatus according to claim 10, wherein a biasing force that the second biasing mechanism applies is smaller than a biasing force that the first biasing mechanism applies.

19. An image recording apparatus comprising:

the conveyance apparatus according to claim 1; and an image forming unit that forms an image on a sheet of paper being conveyed by the conveyance apparatus on a basis of the rotation position of the first roller detected by the encoder.

20. The image recording apparatus according to claim 19, wherein:

the image forming unit comprises:

an inkjet head that ejects ink onto the sheet of paper conveyed by the conveyance apparatus; and a head controller that controls a timing at which the inkjet head ejects the ink, and the head controller controls the timing on a basis of the rotation position of the first roller detected by the encoder.

21. The image recording apparatus according to claim 20, wherein the inkjet head is of a line-type inkjet head extending in a direction perpendicular to a paper conveyance direction.

* * * * *